US007755617B2

(12) United States Patent
Miyazawa

(10) Patent No.: US 7,755,617 B2
(45) Date of Patent: Jul. 13, 2010

(54) ELECTRONIC CIRCUIT, METHOD FOR DRIVING THE SAME, ELECTRONIC DEVICE, AND ELECTRONIC APPARATUS

(75) Inventor: Takashi Miyazawa, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 630 days.

(21) Appl. No.: 11/755,342

(22) Filed: May 30, 2007

(65) Prior Publication Data

US 2007/0290954 A1 Dec. 20, 2007

(30) Foreign Application Priority Data

Jun. 19, 2006 (JP) ..... 2006-168397

(51) Int. Cl.
*G09G 3/30* (2006.01)

(52) U.S. Cl. ..... 345/204; 345/76; 315/169.3

(58) Field of Classification Search ..... 345/76, 345/87, 204, 205, 210, 214; 315/169.3
See application file for complete search history.

(56) References Cited

U.S. PATENT DOCUMENTS

| | | | | |
|---|---|---|---|---|
| 7,446,740 | B2 | 11/2008 | Jung | |
| 2003/0133243 | A1 * | 7/2003 | Imamura | 361/115 |
| 2005/0140601 | A1 * | 6/2005 | Kasai | 345/76 |

FOREIGN PATENT DOCUMENTS

| | | | |
|---|---|---|---|
| JP | A 2004-145280 | 5/2004 | |
| JP | A 2004-245937 | 9/2004 | |
| JP | A 2005-157283 | 6/2005 | |
| JP | A 2005-165258 | 6/2005 | |
| JP | A 2005-309150 | 11/2005 | |
| JP | A 2005-309151 | 11/2005 | |

* cited by examiner

*Primary Examiner*—Amare Mengistu
*Assistant Examiner*—Vince E Kovalick
(74) *Attorney, Agent, or Firm*—Oliff & Berridge, PLC

(57) ABSTRACT

A method drives an electronic circuit for driving a driven element including a transistor which includes control, first, and second terminals, and in which a conduction state representing conduction between the first and second terminals changes depending on a potential of the control terminal, a first capacitive element that includes first and second electrodes, the first electrode being electrically connected to the control terminal, and a second capacitive element that includes third and fourth electrodes, the driven element being supplied with at least one of a driving voltage having a voltage level based on the conduction state in the transistor and a driving current having a current level based on the conduction state in the transistor. The method includes holding a threshold voltage of the transistor by the first capacitive element, with the second and third electrodes separated from each other, holding a data voltage by the second capacitive element, with the second and third electrodes separated from each other, and generating a sum voltage representing the sum of voltages of the first and second capacitive elements by electrically connecting the second and third electrodes, and supplying a potential based on the sum voltage to the control terminal of the transistor.

13 Claims, 13 Drawing Sheets

ELECTRONIC CIRCUIT, METHOD FOR DRIVING THE SAME, ELECTRONIC DEVICE, AND ELECTRONIC APPARATUS

BACKGROUND

1. Technical Field

Several aspects of the present invention relate to a technology for controlling behaviors of various driven elements such as OLED (organic light emitting diode) elements, liquid crystal elements, electrophoresis elements, electrochromic elements, electron emission elements, resistive elements, and sensor elements.

2. Related Art

An electronic device that uses a transistor (hereinafter referred to as a "driving transistor") in order to generate a voltage or current for driving a driven element of the above type has been proposed. For example, in a light emitter that employs OLED elements as driven elements, the values of currents supplied to the OLED elements are controlled by driving transistors provided correspondingly to the OLED elements. This configuration of the light emitter has a problem in that an error in driving transistor characteristic (particularly a threshold value) causes a variation in driving state (such as a grayscale level or brightness) of each driven element. To solve the above problem, JP-A-2004-245937 discloses a configuration for compensating an error in driving transistor threshold value.

FIG. 17 is a circuit diagram showing the configuration disclosed in JP-A-2004-245937. In this configuration, first, a transistor TrA is used to connect a driving transistor Tdr to operate as a diode. This sets a gate of the driving transistor Tdr to have a potential (represented by "Vdd−Vth") based on threshold value Vth. The potential is held by a capacitive element C1. Second, by electrically connecting a data line L and an electrode "a" of a capacitive element C2 through a transistor TrB, a potential (gate potential of the driving transistor Tdr) at the electrode "a" is changed depending on potential Vdata of the data line L. Accordingly, the gate potential of the driving transistor Tdr changes by a level based on a change in potential of the electrode "a", and current Iel (independent from threshold voltage Vth) based on the changed potential is supplied to drive an element E. In order to realize high definition of the driven elements and screen enlargement, it is necessary to set the gate of the driving transistor Tdr to have the potential (Vdd−Vth) based on threshold voltage Vth, and it is also necessary to increase a time for changing the set potential depending on potential Vdata.

SUMMARY

An advantage of some aspects of the invention is that writing of a data voltage is ensured by accurately compensating a threshold voltage of a driving transistor.

According to an aspect of the invention, a method for driving an electronic circuit for driving a driven element is provided. The electronic circuit includes: a transistor which includes a control terminal, a first terminal, and a second terminal, and in which a conduction state between the first terminal and the second terminal changes depending on a potential of the control terminal; a first capacitive element that includes a first electrode and a second electrode, the first electrode being electrically connected to the control terminal; and a second capacitive element that includes a third electrode and a fourth electrode, the driven element being supplied with at least one of a driving voltage having a voltage level based on the conduction state in the transistor and a driving current having a current level based on the conduction state in the transistor.

The method comprises:

supplying a first voltage to the first capacitive element, the supplying of the first voltage being carried out during at least a part of a first period in which the second electrode is electrically separated from the third electrode separated;

supplying a second voltage to the second capacitive element, the supplying of the second voltage being carried out during at least a part of a second period in which the second electrode is electrically separated from the third electrode separated; and setting the potential of the control terminal by connecting electrically the second electrode and the third electrode.

In the above method, the potential of the control terminal set by the setting of the potential of the control terminal may be a voltage representing a sum of the first voltage of the first capacitive element and the second voltage of the second capacitive element, and the sum of the first voltage and the second voltage may be generated by carrying out the connecting electrically of the second electrode and the third electrode.

In the above method, the first voltage may be a threshold of the transistor, and the second voltage may be a data voltage.

According to an aspect of the invention, a method for driving an electronic circuit for driving a driven element is provided. The electronic circuit includes: a transistor which includes a control terminal, a first terminal, and a second terminal, and in which a conduction state between the first terminal and the second terminal changes depending on a potential of the control terminal; a first capacitive element that includes a first electrode and a second electrode, the first electrode being electrically connected to the control terminal; and a second capacitive element that includes a third electrode and a fourth electrode, the driven element being supplied with at least one of a driving voltage having a voltage level based on the conduction state in the transistor and a driving current having a current level based on the conduction state in the transistor.

The method comprises:

supplying a first voltage to the first capacitive element, the supplying of the first voltage being carried out during at least a part of a first period in which the second electrode is electrically separated from the third electrode separated;

supplying a second voltage to the second capacitive element, the supplying of the second voltage being carried out during at least a part of the first period; and setting potential of the control terminal by connecting electrically the second electrode and the third electrode In the above method, the supplying of the first voltage may include electrically connecting the control terminal to the second terminal.

In the above method, the supplying of the first voltage may include electrically connecting the control terminal to the second terminal.

In the above method, the supplying of the second voltage may include a supply of a data voltage to the third electrode.

In the above method, the setting of the potential of the control terminal may include electrically connecting the e the first terminal to the fourth electrode.

According to an aspect of the invention, an electronic circuit for driving a driven element is provided. The electronic circuit comprises:

a transistor which includes a control terminal, a first terminal, and a second terminal, and of which a conduction state between the first terminal and the second terminal changes depending on a potential of the control terminal;

a first capacitive element that includes a first electrode and a second electrode, the first electrode being coupled to the control terminal;

a second capacitive element that includes a third electrode and a fourth electrode; and a first switching element that controls a first electrical connection between the second electrode and the third electrode.

In the above electronic circuit, the potential of the control terminal may be set by electrically connecting the first capacitive element to the second capacitive element through the first switching element, the electrically connecting of the first capacitive element to the second capacitive element may be carried out after supplying a first voltage to the first capacitive element and supplying a second voltage to the second capacitive element, and the driven element may be supplied with at least one of a driving voltage having a voltage level corresponding to the conduction state of the transistor and a driving current having a current level corresponding to the conduction state of the transistor.

The above electronic circuit may further comprise:

a wire electrically connected to the fourth electrode and being supplied with a predetermined potential; and a second switching element that controls a second electrical connection between the second electrode and the third electrode.

The above electronic circuit may further comprise a wire that is supplied with a predetermined potential;

a second switching element that controls a second electrical connection between the second electrode and the wire;

a third switching element that controls a third electrical connection between the wire and the fourth electrode; and a fourth switching element that controls a fourth electrical connection between the fourth electrode and one of the first terminal and the second terminal.

According to an aspect of the invention, an electronic device is provided. The electronic device comprises:

a plurality of data lines; and a plurality of unit circuits,

In the electronic device, each of the plurality of unit circuits may include:

a transistor which includes a control terminal, a first terminal, and a second terminal, and of which a conduction state between the first terminal and the second terminal changes depending on a potential of the control terminal;

a driven element that is supplied with one of a driving voltage having a voltage level according to the conduction state of the transistor and a driving current having a current level according to the conduction state of the transistor;

a first capacitive element that includes a first electrode and a second electrode, the first electrode being coupled to the control terminal;

a second capacitive element that includes a third electrode and a fourth electrode; and a first switching element that controls an electrical connection between the first capacitive element and the second capacitive element.

In the above electronic device, the potential of the control terminal may be set by electrically connecting the first capacitive element to the second capacitive element through the first switching element, the electrically connecting of the first capacitive element to the second capacitive element may be carried out after supplying a first voltage to the first capacitive element and supplying a second voltage to the second capacitive element, and the driven element may be supplied with at least one of a driving voltage having a voltage level corresponding to the conduction state of the transistor and a driving current having a current level corresponding to the conduction state of the transistor An electronic apparatus according to an aspect of the invention comprises the above electronic device.

According to an aspect of the invention, a method for driving an electronic circuit for driving a driven element is provided. The electronic circuit includes: a driving transistor which includes a control terminal, a first terminal, and a second terminal, and in which a conduction state representing electric conduction between the first terminal and the second terminal changes depending on a potential of the control terminal; a first capacitive element that includes a first electrode and a second electrode, the first electrode being electrically connected to the control terminal; and a second capacitive element that includes a third electrode and a fourth electrode, the driven element being supplied with at least one of a driving voltage having a voltage level based on the conduction state in the driving transistor and a driving current having a current level based on the conduction state in the driving transistor. The method includes: holding a threshold voltage of the driving transistor by the first capacitive element, with the second electrode and the third electrode separated from each other; holding a data voltage by the second capacitive element, with the second electrode and the third electrode separated from each other; and generating a sum voltage representing the sum of a voltage of the first capacitive element and a voltage of the second capacitive element by electrically connecting the second electrode and the third electrode, and supplying a potential based on the sum voltage to the control terminal of the driving transistor. The holding of the threshold voltage is executed in a compensation period. The holding of the data voltage is executed in a writing period. The supplying of the potential is executed in a driving period.

According to the above aspect of the invention, the threshold voltage and the data voltage can be written, with the first capacitive element and the second capacitive element electrically separated from each other. By electrically connecting the second electrode and the third electrode, the threshold value and the data voltage are added and the potential of the control terminal of the driving transistor is controlled on the basis of the sum of the voltages. Thus, a driving current or driving voltage with the threshold voltage corrected can be supplied to the driven element.

It is preferable that a period in which at least part of the holding of the threshold voltage and at least part of the holding of the data voltage are simultaneously performed be set.

As described above, the electronic circuit in the above aspect of the invention includes a first capacitive element for holding a threshold value and a second capacitive element, separate from the first capacitive element, for holding a data voltage. In the compensation period and the writing period, writing of the threshold voltage and writing of the data voltage are separately performed, with both electrically separated from each other. Accordingly, the compensation period and the writing period can overlap with each other. By executing both periods in parallel, a time for writing the threshold value to the first capacitive element and a time for writing the data voltage to the second capacitive element can be increased. This can accurately correct the threshold voltage and can drive the driven element on the basis of an accurate data voltage.

In the above method, it is preferable that, in the driving transistor, the conduction state between the first terminal and the second terminal change depending on a voltage between the control terminal and the first terminal, and it is preferable that, in at least part of the holding of the threshold voltage, electric charge based on the threshold voltage be stored in the first capacitive element by electrically connecting the control terminal to the second terminal. In this case, the driving transistor is connected to operate as a diode, and its threshold value can be held by the first capacitive element.

It is preferable that, in the holding of the data voltage, a potential based on the data voltage be supplied to the third electrode. In this case, by fixing a potential of the fourth electrode, the data voltage can be written in the second capacitive element.

It is preferable that, in the driving transistor, the conduction state between the first terminal and the second terminal change depending on a voltage between the control terminal and the first terminal, and it is preferable that, in at least part of the supplying of the potential, electric conduction be established between the first terminal of the driving transistor the fourth electrode of the second capacitive element.

In this case, a sum voltage representing the sum of the threshold voltage held in the first capacitive element and the data voltage held in the second capacitive element is input to the control terminal, with the potential of the first terminal of the driving transistor used as a reference. Thus, the driven element can be driven, while compensating the threshold value of the driving transistor.

According to another aspect of the invention, an electronic circuit for driving a driven element is provided. The driven element includes: a driving transistor which includes a control terminal, a first terminal, and a second terminal, and in which a conduction state representing electric conduction between the first terminal and the second terminal changes depending on a potential of the control terminal; a first capacitive element that includes a first electrode and a second electrode, the first electrode being electrically connected to the control terminal; a second capacitive element that includes a third electrode and a fourth electrode; a first switching element which electrically connects the second electrode and the third electrode when the first switching element is in an on-state and which electrically insulates the second electrode and the third electrode when the first switching element is in an off-state; and a controller that, after holding a threshold voltage of the driving transistor in the first capacitive element and simultaneously holding a data voltage in the second capacitive element by setting the first switching element to be in the off-state, generates a sum voltage representing the sum of the threshold voltage and the data voltage and supplies a potential based on the sum voltage to the control terminal of the driving transistor by setting the first switching element to be in the on-state. The driven element is supplied with at least one of a driving voltage having a voltage level based on the conduction state in the driving transistor and a driving current having a current level based on the conduction state in the driving transistor.

Preferably, the electronic circuit further include: a wire electrically connected to the fourth electrode and being supplied with a predetermined potential; and a second switching element which electrically connects the wire and the second switching element when the second switching element is in an on-state and which electrically insulates the wire and the second switching element when the second switching element is in an off-state. After the controller controls the first capacitive element to hold the threshold voltage of the driving transistor and controls the second capacitive element to hold the data voltage by setting the first switching element to be in the off-state and setting the second switching element to be in the on-state, the controller generates a sum voltage representing the sum of the threshold voltage and the data voltage and supplies a potential based on the sum voltage to the control terminal of the driving transistor by setting the first switching element to be in the on-state.

In this case, when the voltages are written in the first capacitive element and the second capacitive element, a reference voltage can be used in common. Accordingly, even if a predetermined potential varies, a potential that is used as a reference for the first capacitive element and the second capacitive element only varies at the same time. Thus, the threshold voltage and data voltage held in both capacitive elements are riot affected.

Preferably, the control terminal, first terminal, and second terminal of the driving transistor are a gate, source, and drain of the driving transistor. It is preferable that the electronic circuit further include: a wire that is supplied with a predetermined potential; a second switching element which electrically connects the wire and the second electrode when the second switching element is in an on-state and which electrically insulates the wire and the second electrode when the second switching element is in an off-state; a third switching element which electrically connects the wire and the fourth electrode when the third switching element is in an on-state and which electrically insulates the wire and the fourth electrode when the third switching element is in an off-state; and a fourth switching element which electrically connects the fourth electrode and the source of the driving transistor when the fourth switching element is in an on-state and which electrically insulates the fourth electrode and the source of the driving transistor when the fourth switching element is in an off-state. It is preferable that, after the controller controls the first capacitive element to hold the threshold voltage of the driving transistor and simultaneously controls the second capacitive element to hold the data voltage by setting the first switching element to be in the off-state, setting the second switching element to be in the on-state, and setting the third switching element to be in the on-state, the controller generate a sum voltage representing the sum of the threshold voltage and the data voltage by setting the first switching element to be in the on-state and setting the second switching element to be in the off-state, and supplies a potential based on the sum voltage to the gate of the driving transistor by setting the third switching element to be in the off-state and setting the fourth switching element to be in the on-state.

In this case, after the first capacitive element and the second capacitive element are electrically connected to each other, a source potential of the driving transistor can be fed back to the fourth electrode of the second capacitive element. Thus, a voltage that is the sum of the threshold voltage and the data voltage can be applied across the gate and source of the driving transistor. This can compensate the threshold value of the driving transistor.

According to a further aspect of the invention, an electronic circuit including a plurality of data lines and a plurality of unit circuits is provided. Each unit circuit includes: a driving transistor which includes a control terminal, a first terminal, and a second terminal, and in which a conduction state representing electric conduction between the first terminal and the second terminal changes depending on a potential of the control terminal; a driven element that is supplied with one of a driving voltage having a voltage level based on the conduction state in the driving transistor and a driving current having a current level based on the conduction state in the driving transistor; a first capacitive element that includes a first electrode and a second electrode, the first electrode being electrically connected to the control terminal; a second capacitive element that includes a third electrode and a fourth electrode; and a first switching element which electrically connects the second electrode and the third electrode when the first switching element is in an on-state and which electrically insulates the second electrode and the third electrode when the first switching element is in an off-state; and a controller that, after controlling the first capacitive element to hold a threshold voltage of the driving transistor and simultaneously controlling the second capacitive element to hold a data voltage by setting the first switching element to be in the off-state, generates a sum voltage representing the sum of the threshold voltage and the data voltage and supplying a potential based on the sum voltage to the control terminal of the driving transistor by setting the first switching element to be in the on-state.

A typical example of the above electronic circuit is an electro-optical device (e.g. a light emitter that employs an emission element as an electro-optical element) that employs, as a driven element, an electro-optical element whose optical property, such as luminance or transmittance is changed when being supplied with electric energy, The electronic device is used in various types of electronic apparatuses. Typical examples of the electronic circuit are apparatuses that use the electronic device as a display device. Electronic devices of the above type include personal computers and cellular phones. Uses of the electronic device according to the above aspect are not limited to display of images. The electronic device according to the above aspect may be applied to various uses such as an exposure device (exposure head) for forming a latent image on an image supporter such as a photosensitive drum by emitting a beam, a device (backlight) provided behind a liquid crystal device for illuminating the liquid crystal device, and a device provided in an image reader such as a scanner for illuminating an original.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
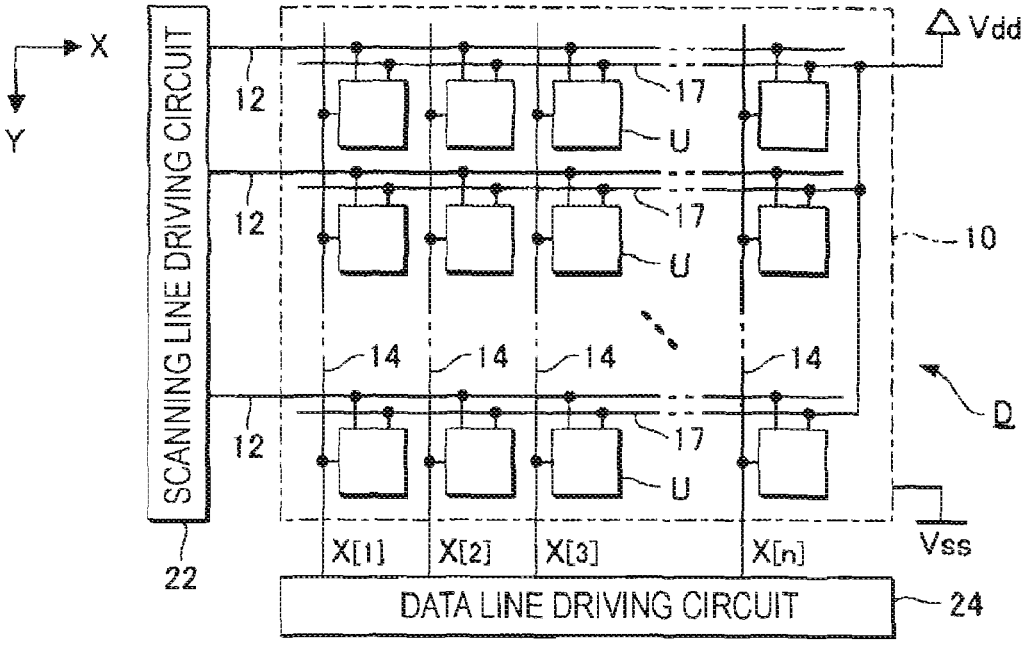
FIG. 1 is a block diagram showing the configuration of an electronic device according to a first embodiment of the invention.

FIG. 1 is a block diagram showing the configuration of an electronic device D according to a first embodiment of the invention. The electronic device D shown in FIG. 1 is an electro-optical device (light emission device) that is provided as an image display unit in various electronic apparatuses. The electronic device D includes an element array section 10 in which a plurality of unit circuits (pixel circuits) U are two-dimensionally arranged, and a scanning line driving circuit 22 and data line driving circuit 24 for driving the unit circuits U. The scanning line driving circuit 22 and the data line driving circuit 24 may be formed by transistors formed on a substrate together with the element array section 10 and may be mounted in an IC (integrated circuit) chip form.

As shown in FIG. 1, the element array section 10 includes thereon "m" scanning lines 12 extending in an X-direction and "n" data lines 14 extending in a Y-direction perpendicular to the X-direction, where both "m" and "n" are natural numbers. The unit circuits U are respectively arranged correspondingly to intersections between the scanning lines 12 and the data lines 14. Accordingly, the unit circuits U are arranged in a matrix of m rows and n columns. High power supply potential Vdd is supplied to each unit circuit U through each of power-supply lines 17 extending in the X-direction the power-supply lines 17 being paired with the scanning lines 12.

The scanning line driving circuit 22 is used to sequentially select each of the scanning lines 12. The data line driving circuit 24 generates data signals X[1] to X[n] that respectively correspond to the (n) unit circuits U (for a row) connected to one scanning line 1.2 selected by the scanning line driving circuit 22, and outputs data signals X[1] to X[n] to the data lines 14. Data signal X[j], supplied to a data line 14 in the j-th column (j represents an integer satisfying $1 \leqq j \leqq n$) in a period (data writing period P2 (described later)) in which a scanning line 12 in the i-th row (i represents an integer satisfying $1 \leqq i \leqq m$) is selected, has a potential (represented by "Vdd−Vdata") based on a grayscale level specified by unit circuit U in the i-th row and the j-th column. A grayscale level of each unit circuit U is specified by externally supplied grayscale data.

Figure 2:
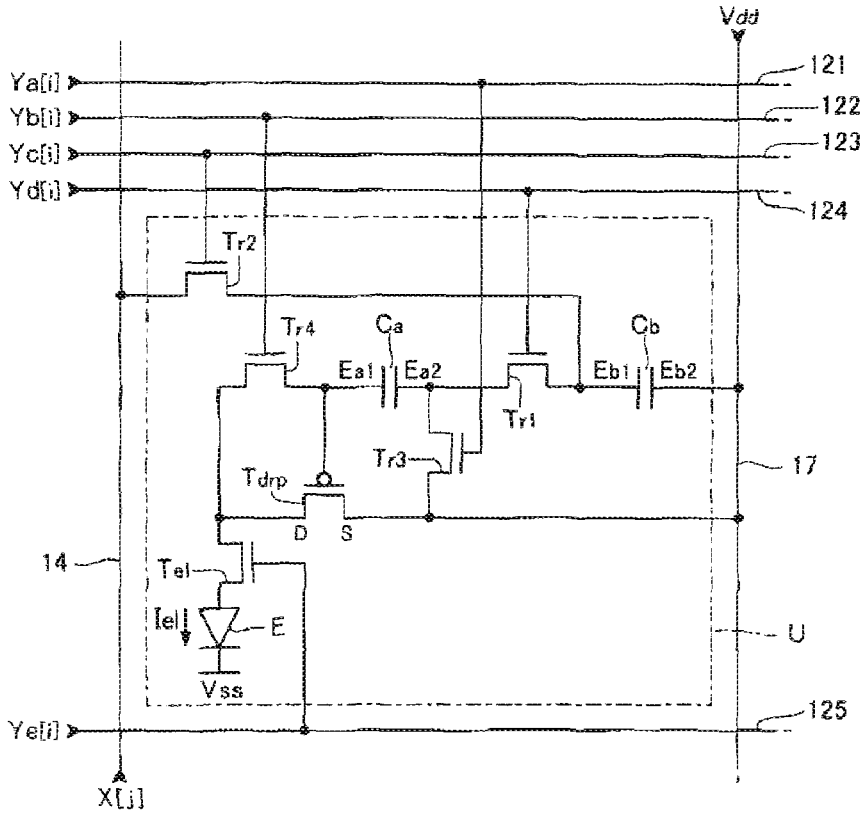
FIG. 2 is a circuit diagram showing the configuration of a unit circuit.

Next, a specific configuration of each unit circuit U is described below with reference to FIG. 2. Although FIG. 2 shows only one unit circuit U in the i-th row and the j-th column, the other unit circuits U are identical in configuration. As shown in FIG. 2, the unit circuit U includes an electro-optical element E between the power-supply line 17 and a portion having low power-supply potential Vss. The Electro-optical element E is a current-driven type of a driven element has a grayscale level (brightness) based on supplied driving current Iel. The Electro-optical element E in the first embodiment is an OLED element (light emitting element) having positive and negative electrodes, and a light emitting layer provided therebetween, the layer is being formed of an organic EL (electroluminescent) material. The negative electrode of the electro-optical element E is grounded (indicated by "Vss").

As shown in FIG. 2, the scanning line 12 that is shown for brevity of description, as a wire in FIG. 1, actually includes five wires, that is, a first control line 121, a second control line 122, a third control line 123, a fourth control line 124, and a fifth control line 125. Predetermined signals are supplied from the scanning line driving circuit 22 to the control lines 121 to 125. More specifically, first control signal Ya[i] is supplied to the first control line 121, which is included in the scanning line 12 in the i-th row. Similarly, second control signal Yb[i] is supplied to the second control line 122. Third control signal Yc[i] is supplied to the third control line 123. Fourth control signal Yd[i] is supplied to the fourth control line 124. Fifth control signal Ye[i] is supplied to the fifth control line 125. Specific waveforms of the control signals 121 to 125 and an operation of the unit circuit U are described later.

As shown in FIG. 2, a p-channel driving transistor Tdrp is provided on a path from the power-supply line 17 to the positive electrode of the electro-optical element E. A source (S) of the driving transistor Tdrp is connected to the power-supply line 17. A conduction state (source-drain resistance) across the source and drain (D) of the driving transistor Tdrp changes depending on potential Vg of a gate, whereby the driving transistor Tdrp generates driving current Iel based on gate potential Vg. In other words, the electro-optical element E is driven depending on the conduction state of the driving transistor Tdrp. In the first embodiment, for brevity of description, on the basis of the magnitude of potential during a period In which driving current Iel flows from the driving transistor Tdrp to the electro-optical element E, a first terminal of the driving transistor Tdrp on the side of the electro-optical element E is defined as a drain and a second terminal of the driving transistor Tdrp on the side of the power-supply line 17 is defined as a source. For example, in a period in which a current (reverse bias current) reverse to a flowing direction of driving current Iel flows in the driving transistor Tdrp, the source and drain of the driving transistor Tdrp reverse.

An n-channel transistor (hereinafter referred to as an "emission-control transistor"), indicated by "Tel", for controlling electric connection between the drain of the driving transistor Tdrp and the positive electrode of the electro-optical element E is provided therebetween. The gate of the emission-control transistor Tel is connected to the fifth control line 125. Accordingly, when fifth control signal Ye[i] changes to be high in level, the emission-control transistor Tel changes to be on, thus enabling supplying driving current Iel to the electro-optical element E. Conversely, when fifth control signal Ye[i] is low in level, the emission-control transistor Tel maintains to be off, so that the path of driving current Iel is blocked, thus turning off the electro-optical element E.

As shown in FIG. 2, the unit circuit U in the first embodiment includes two capacitive elements Ca and Cb, and four n-channel transistors Tr1, Tr2, Tr3, and Tr4. The capacitive element Ca is an element formed by a dielectric provided in a gap between electrodes Ea1 and Ea2. Similarly, the capacitive element Cb is an element formed by a dielectric provided in a gap between electrodes Eb1 and Eb2. The electrode Ea1 of the capacitive element Ca is connected to the gate of the driving transistor Tdrp. The electrode Eb2 of the capacitive element Cb is connected to the power-supply line 17. The transistor Tr1 is a switching element that is provided, between the electrode Ea2 of the capacitive element Ca and the electrode Eb1 of the capacitive element Cb, for controlling electric connection (conduction/nonconduction) between both. The gate of the transistor Tr1 is connected to the fourth control line 124.

The transistor Tr2 is a switching element that is provided, between the electrode Eb1 of the capacitive element Cb and the data line 14, for controlling electric connection between both. The transistor Tr3 is a switching element that is provided, between the electrode Ea2 of the capacitive element Ca and the power-supply line 17 (the source of the driving transistor Tdrp), for controlling electric connection between both. The gate of the transistor Tr2 is connected to the third control line 123 and the gate of the transistor Tr3 is connected to the first control line 121.

The transistor Tr4 is a switching element that is provided, across the gate and drain of the driving transistor Tdrp, for controlling electric connection between both. When the transistor Tr4 changes to be on, the driving transistor Tdrp is connected to operate as a diode. The gate of the transistor Tr4 is connected to the second control line 122.

Figure 3:
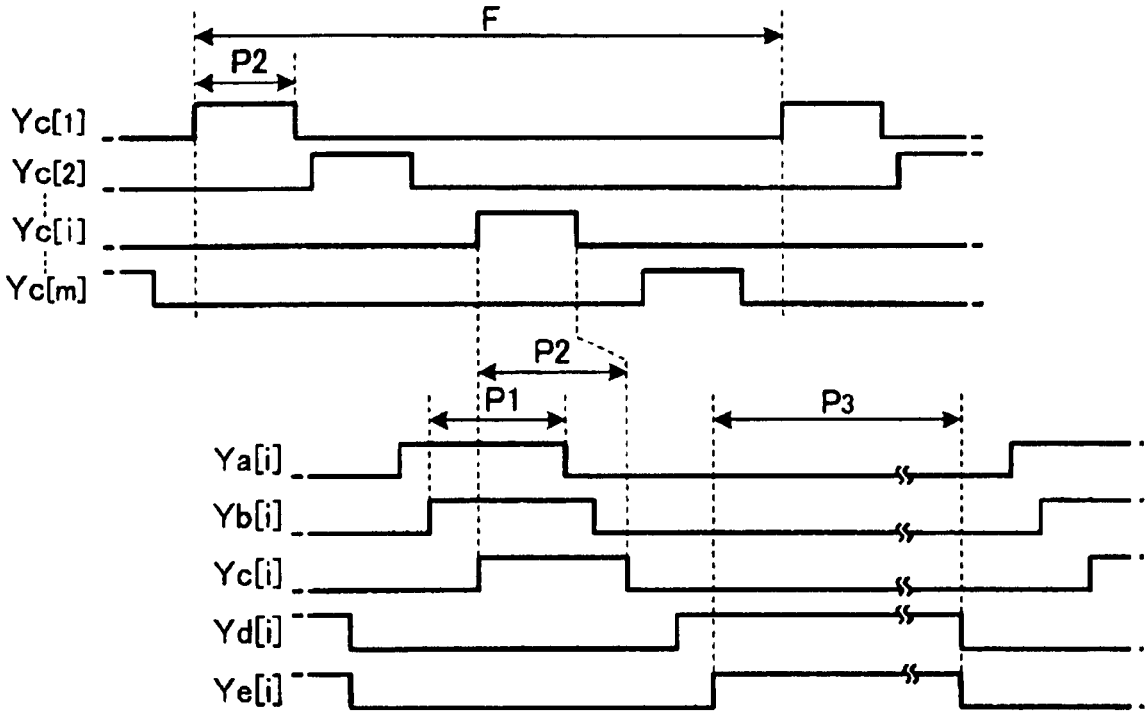
FIG. 3 is a timing chart illustrating the operation of an electronic device.

Next, specific waveforms of signals used in the electronic device D are described below with reference to FIG. 3. Third control signal Yc[i] includes third control signals Yc[1] to Yc[m]. As shown in FIG. 3, third control signals Yc[1] to Yc[m] sequentially become high in level for each predetermined period P2 (hereinafter referred to as the "data writing period P2") in each frame period F. That is, third control signal Yc[i] maintains to be high during the i-th data writing period P2 in one frame period F, and maintains to be low in level in the other periods. Change of third control signal Yc[i] to be high indicates that the i-th row is selected.

As shown in FIG. 3, first control signal Ya[i] becomes high in level in a predetermined period before the data writing period P2 in which third control signal Yc[i] is high, and maintains to be low in level. Second control signal Yb[i] becomes high in level in a predetermined period after first control signal Ya[i] becomes high in level. In a predetermined period P1 hereinafter referred to as a "compensation period P1") in which both first control signal Ya[i] and second control signal Yb[i] are high in level, threshold voltage of the driving transistor Tdrp is compensated.

After fourth control signal Yd[i] becomes high in level in a predetermined period after the data writing period P2 passes, in a predetermined period, fifth control signal Ye[i] becomes high in level. In a predetermined period P3 (hereinafter referred to as a "driving period P3") in which both fourth control signal Yd[L] and fifth control signal Ye[i] are high in level, driving current Iel is supplied to the electro-optical element E. In addition, first control signal. Ya[i] and second control signal Yb[i] can be made identical in waveform. Fourth control signal Yd[i] and fifth control signal Ye[i] can be made identical in waveform. In these cases, the number of control lines can be reduced.

The data writing period P2 is used for the capacitive element Ca to hold voltage Vdata based on the grayscale level specified by the unit circuit U on the basis of externally supplied grayscale data. The compensation period P1 is used for the capacitive element Cb to hold threshold voltage Vth of the driving transistor Tdrp. In the driving period P3, the electro-optical element E is driven on the basis of voltage Vdata (data voltage) held by the capacitive element Ca and threshold voltage Vth held by the capacitive element Cb.

Details of the operation of the unit circuit U in the i-th row and the j-th column are described below with reference to FIGS. 4 to 6, with the details divided into cases of the compensation period P1, the data writing period P2, and the driving period P3.

Figure 4:
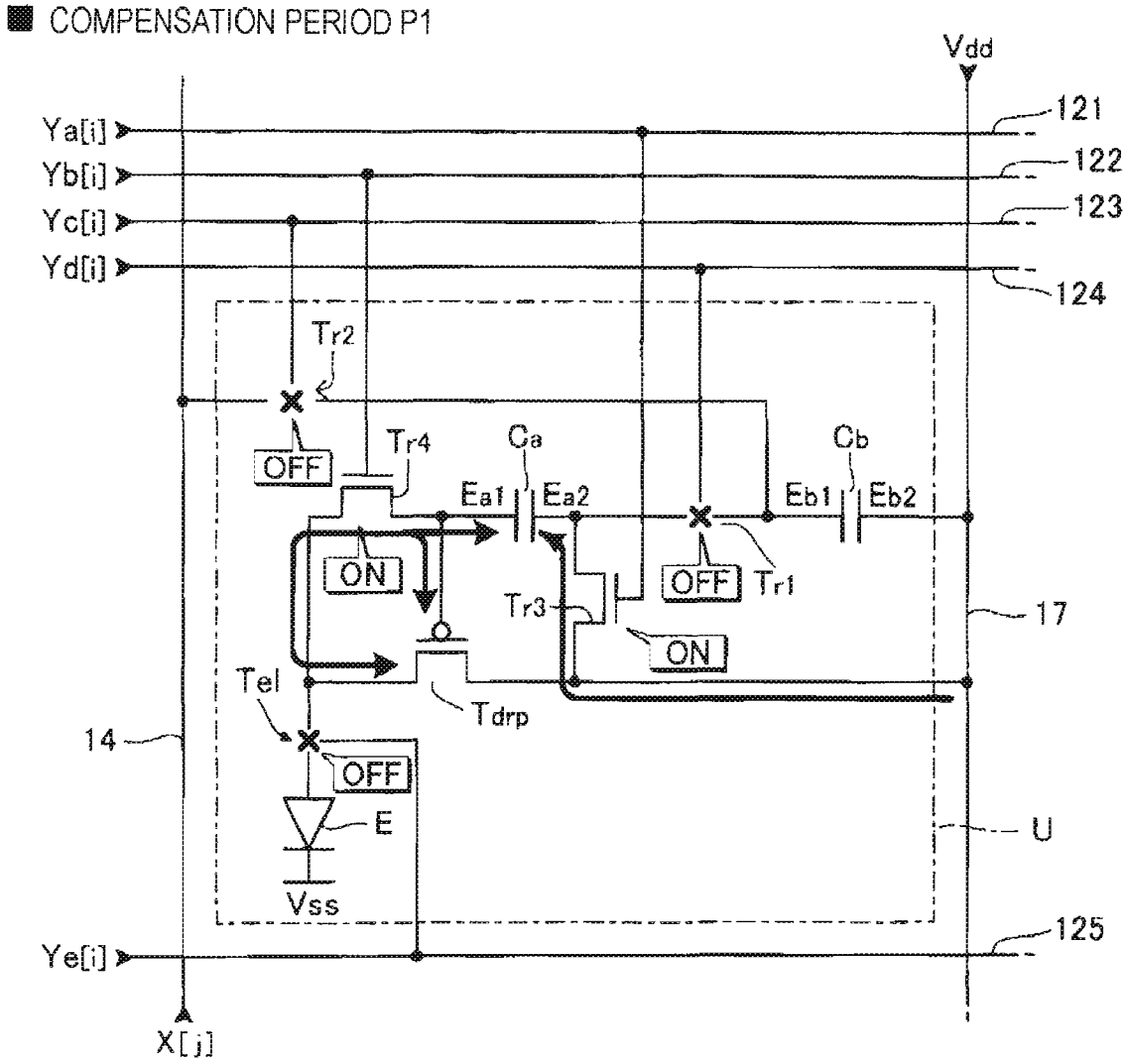
FIG. 4 is a circuit diagram showing details of the unit circuit in a compensation period.

Compensation Period P1 (FIG. 4)

FIG. 4 shows details of the unit circuit U in the compensation period P1 in which third control signal Yc[i] is low in level. In this state, first control signal Ya[i] is high thus switching on the transistor Tr3, so that higher power-supply potential Vdd is supplied to the electrode Ea2 of the capacitive element Ca. Change of second control signal Yb[i] to be high switches on the transistor Tr4, thus establishing electric connection across the gate and drain of the driving transistor Tdrp. In other words, this establishes a path from the power-supply line 17 to the electrode Ea1 of the capacitive element Ca through the source and drain of the driving transistor Tdrp, the transistor Tr4, and the gate of the driving transistor Tdrp. A current flows in this path, whereby the potential of the electrode Ea1 converges to a difference represented by "Vdd−Vth" between higher power-supply potential Vdd and threshold voltage Vth of the driving transistor Tdrp. The electrode Ea2 is maintained to have higher power-supply potential Vdd. Thus, in the compensation period P1, electric charge based on threshold voltage Vth is stored in the capacitive element Ca. That is, threshold voltage Vth is held by the capacitive element Ca. Change of third control signal Yc[i] to be low switches off the transistor Tr2. This electrically separates the electrode Eb1 of the capacitive element Ca from the data line 14. Change of fourth control signal Yd[i] to be low switches off the transistor Tr1. This electrically separates the electrode Eb1 of the capacitive element Cb from the data line 14. This causes the electrode Eb1 to be in a floating state. Furthermore, when fifth control signal Ye[i] is low, the emission-control transistor Tel maintains to be off, thus stopping supply of driving current Iel to the electro-optical element E.

Figure 5:
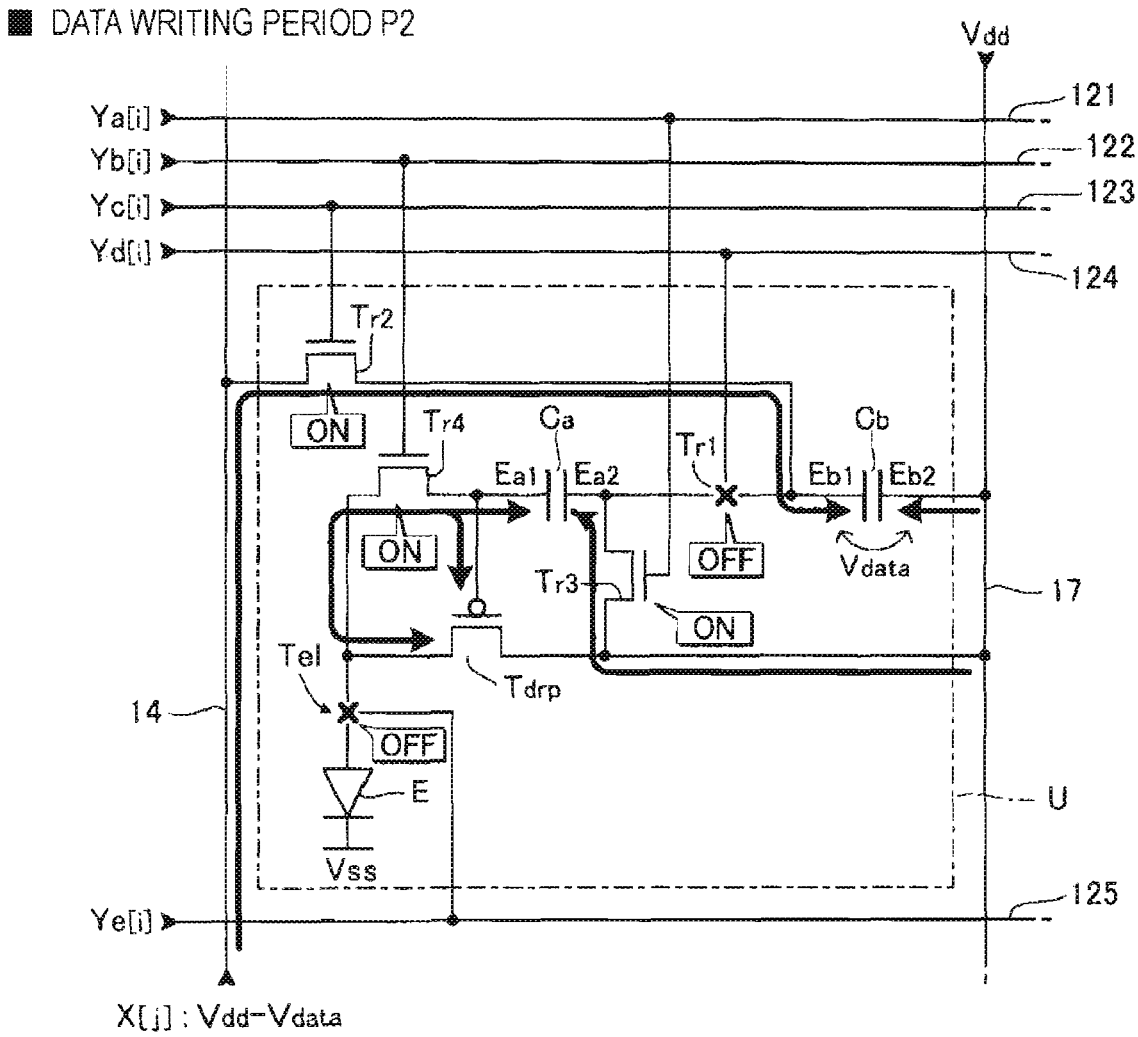
FIG. 5 is a circuit diagram showing details of the unit circuit in a data writing period.

Data Writing Period P2 (FIG. 5)

FIG. 5 shows details of the unit circuit U in the data writing period P2 in which second control signal Yb[i] is high in level. In this state, similarly to the above-described compensation period P1, electric charge based on threshold voltage Vth is stored in the capacitive element Ca. The transistor Tr2 is switched on since third control signal Yc[i] changes to be from low to high. This electrically connects the electrode Eb1 of the capacitive element Cb to the data line 14. The potential (Vdd−Vdata) is supplied as data signal X[j] to the data line 14. The electrode Eb2 of the capacitive element Cb is connected to the power-supply line 17, thus supplying higher power-supply potential Vdd to the electrode Eb2 of the capacitive element Cb. Therefore, electric charge based on voltage Vdata is stored in the capacitive element Cb. That is, voltage Vdata is held by the capacitive element Cb. In other words, in a period in which the compensation period P1 and the data writing period P2 overlap with each other, threshold voltage Vth is written in the capacitive element Ca and voltage Vdata is written in the capacitive element Cb. A compensating operation and a writing operation can be executed in parallel because the capacitive elements Ca and Cb are electrically separated by providing transistor Tr1 between both to allow the transistor Tr1 to be off. As described above, by simultaneously executing the compensating operation and the writing operation, times of the operations can be increased. This accurately converges the voltage of the capacitive element Ca and sufficiently writes voltage Vdata in the capacitive element Cb.

Figure 6:
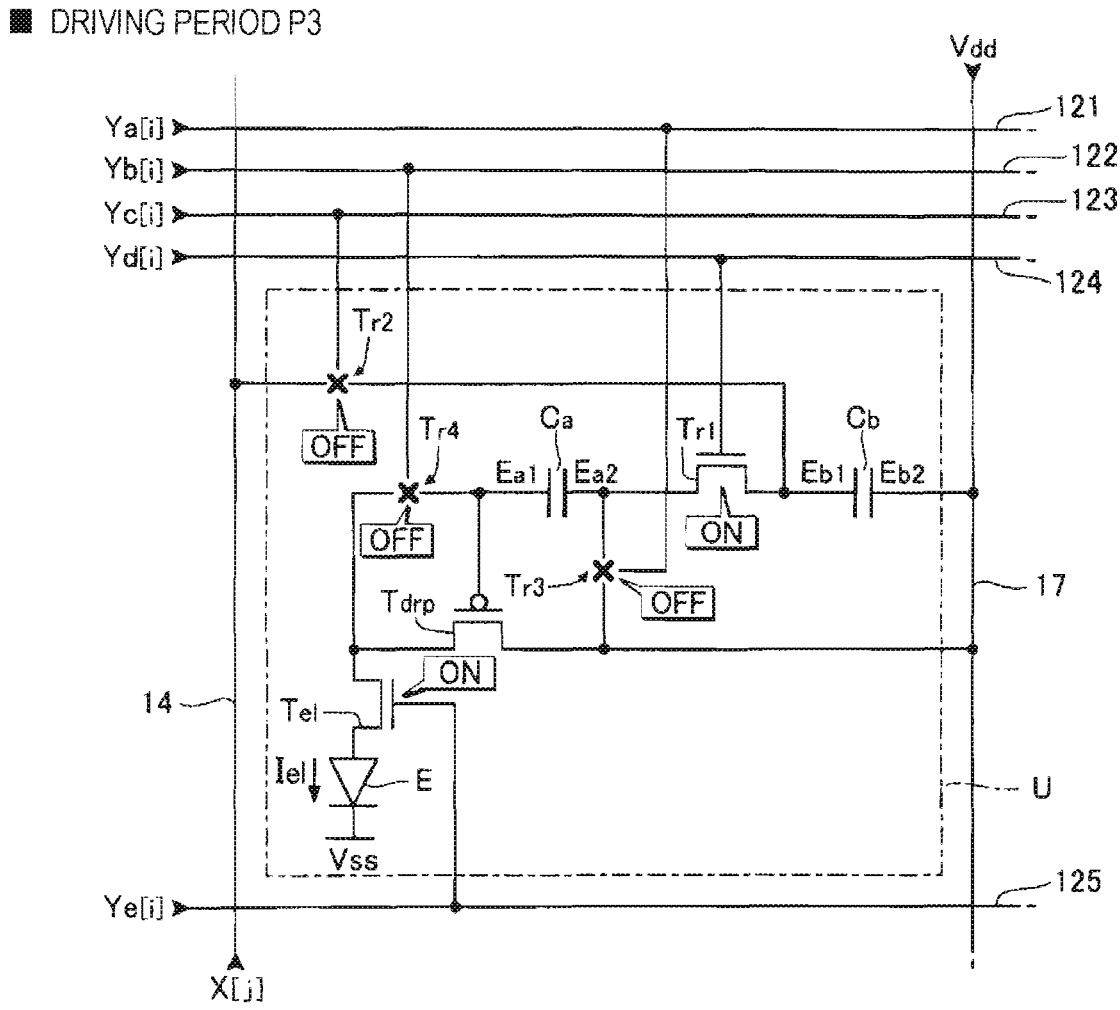
FIG. 6 is a circuit diagram showing details of the unit circuit in a driving period.

Driving Period P3 (FIG. 6)

FIG. 6 shows details of the unit circuit U in the driving period P3. In this state, first control signal Ya[i], second control signal Yb[i], and third control signal Yc[i] are low in level. Accordingly, the transistor Tr3 is off, thus electrically separating the electrode Ea2 of the capacitive element Ca from the power-supply line 17. In addition, the transistor Tr4 is switched off, thus disconnecting the diode-connected driving transistor Tdrp. The transistor Tr2 is switched off, thus electrically separating the data line 14 and the electrode Eb1 of the capacitive element Cb.

In addition, in the driving period P3, fourth control signal Yd[i] becomes high in level and the transistor Tr1 changes to be on, thus establishing electric connection between the electrode Ea2 of the capacitive element Ca and the electrode Eb1 of the capacitive element Cb. At this time, the electrode Ea1 of the capacitive element Ca is in the floating state. Accordingly, when the transistor Tr1 is used to connect the electrodes Ea2 and Eb1, the potential (i.e., gate potential Vg) of the electrode Ea1 varies. At the time immediately before the driving period P3, threshold voltage Vth is stored in the capacitive element Ca and the voltage Vdata is held by the capacitive element Cb. Thus, when the transistor Tr1 changes to be on in the driving period P3, gate potential Vg of the electrode Ea1 changes to a value represented by "Vdd−Vdata−Vth". Specifically, threshold voltage Vth held by the capacitive element Ca and the voltage Vdata held by the capacitive element Cb are added to generate a sum voltage represented by "Vdata+Vth". The potential "Vdd−Vdata−Vth" based on the sum voltage is applied to the driving transistor Tdrp.

Furthermore, in the driving period P3, fifth control signal Ye[i] changes to be high In level, thus switching on the emission-control transistor Tel. Therefore, driving current Iel based on gate potential Vg of the driving transistor Tdrp is supplied from the power-supply line 17 to the electro-optical element E through the driving transistor Tdrp and the emission-control transistor Tel. Assuming that the driving transistor Tdrp operates in a saturation region, driving currents Iel is represented by $$Iel=(\beta/2)(Vgs-Vth)^2 \tag{1}$$

where β represents a gain coefficient of the driving transistor Tdrp, and Vgs represents a gate-source voltage of the driving transistor Tdrp.

The source of the driving transistor Tdrp is connected to the power-supply line 17. Thus, voltage Vgs is represented by a difference between gate potential Vg and higher power-supply potential Vdd. That is, Vgs=Vdd−Vg. Considering that, in the driving period P3, gate potential Vg is set to "Vdd−Vdata−Vth", expression (1) is transformed to the following:

$$\begin{aligned} Iel &= (\beta/2)\{Vdd-(Vdd-Vdata-Vth)-Vth\}^2 \\ &= (\beta/2)(Vdata)^2 \end{aligned} \tag{2}$$

As can be understood from expression (2), driving current Iel is determined by voltage Vdata, and is independent from threshold voltage Vth of the driving transistor Tdrp. Therefore, a variation in threshold voltage Vth of the driving transistor Tdrp in the unit circuit U is compensated to suppress irregularity in grayscale level (brightness) of the electro-optical element E.

As described above, in the first embodiment, the compensation period P1 and the data writing period P2 can overlap with each other. This can increase the times of the compensation period P1 and the data writing period P2, thus accurately compensating threshold voltage Vth and sufficiently writing voltage Vdata. As a result, irregularity in brightness can be eliminated and display grayscale accuracy can be improved.

Second Embodiment

Next, a second embodiment of the invention is described below. In the second embodiment, components common to those in the first embodiment are not described, if needed, since the components are denoted by identical reference numerals.

Figure 7:
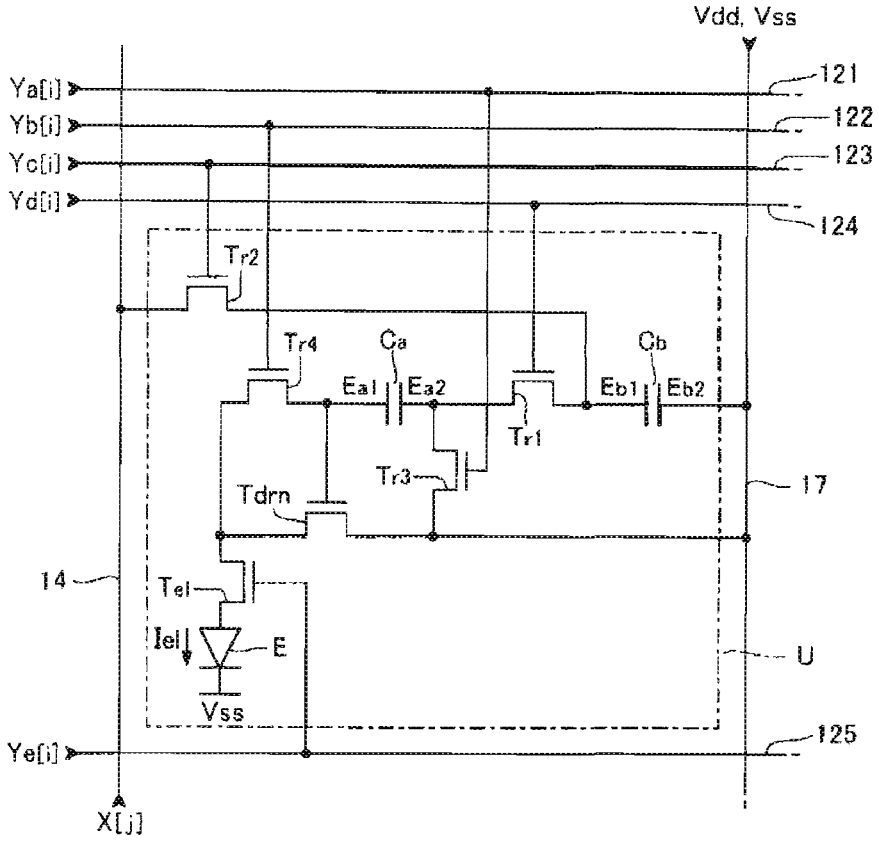
FIG. 7 is a circuit diagram showing the configuration of a unit circuit in a second embodiment of the invention.

FIG. 7 is a circuit diagram showing the configuration of the unit circuit U in the second embodiment. The unit circuit U in the second embodiment is identical in configuration to that in the first embodiment except that an n-channel driving transistor Tdrn is used instead of the driving transistor Tdrp in the first embodiment.

Figure 8:
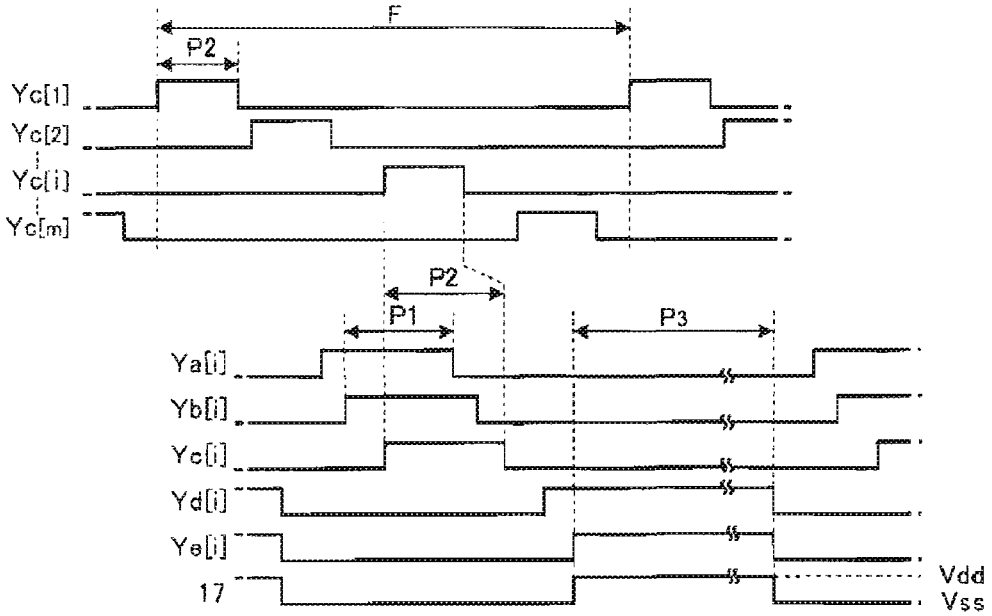
FIG. 8 is a timing chart illustrating an operation of an electronic device.

FIG. 8 shows specific waveforms of signals used in the electronic device D. First to fifth control signals Ya[i] to Ye[L] are identical in waveform to those (FIG. 3) in the first embodiment. The power-supply potential supplied to the power-supply line 17 differs. In other words, in the second embodiment, in the driving period P3, higher power-supply potential Vdd is supplied to the power-supply line 17, while, in the other periods, lower power-supply potential Vss is supplied to the power-supply line 17.

Figure 9:
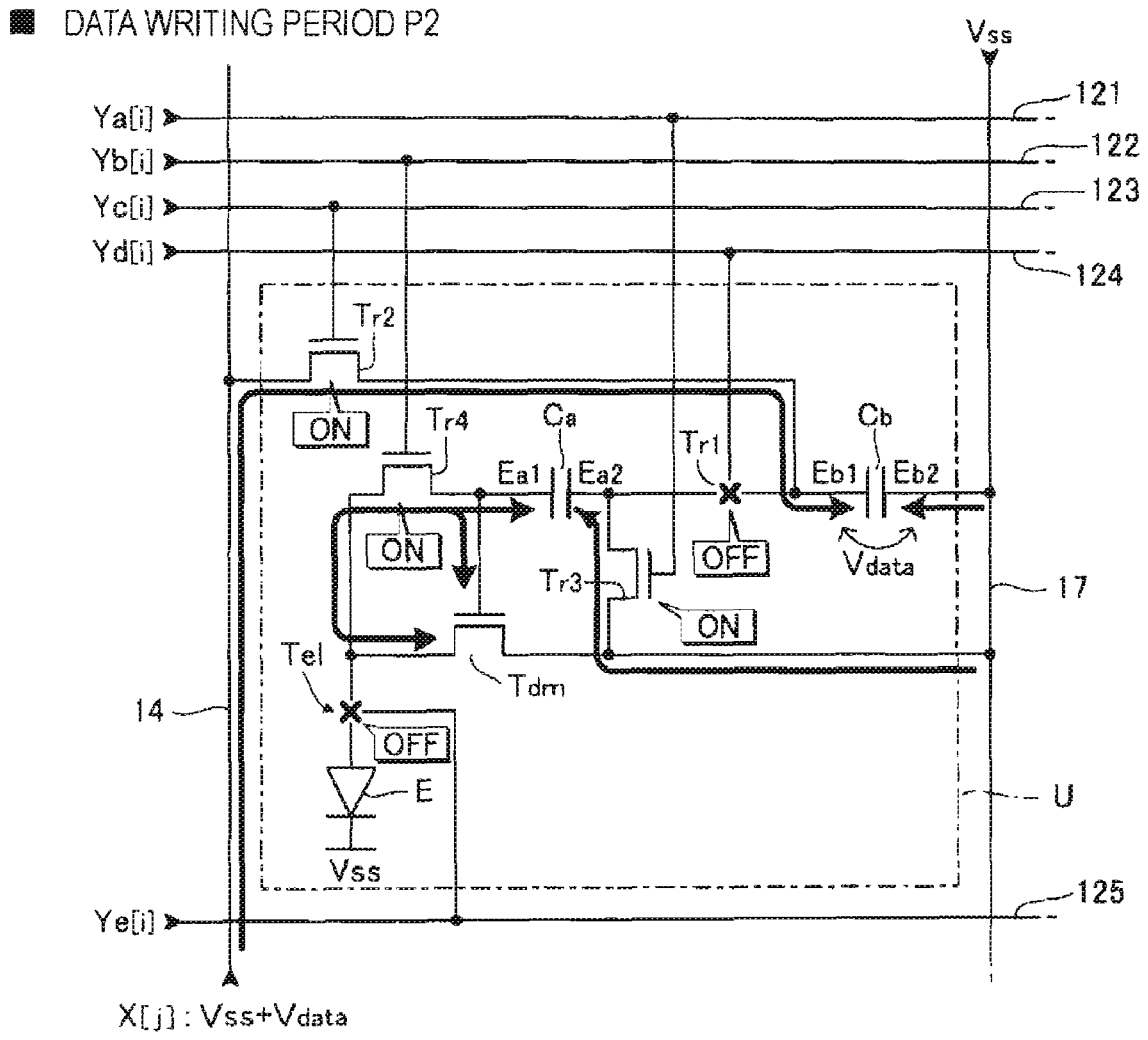
FIG. 9 is a circuit diagram showing details of the unit circuit in the data writing period.

FIG. 9 shows details of the unit circuit U in the data writing period P2 in which second control signal Yb[i] is high in level. In this state, the transistor Tr3 is switched on, thus supplying lower power-supply potential Vss to the electrode Ea2 of the capacitive element Ca. In addition, the transistor Tr4 is switched on, thus causing the driving transistor Tdrn to be connected to operate as a diode, so that a current flows from the source to drain of the driving transistor Tdrn and the potential of the electrode Ea1 of the capacitive element Ca gradually approaches a value represented by "Vss+Vth". This stores charge corresponding to threshold voltage Vth in the capacitive element Ca. For the capacitive element Cb, the transistor Tr2 is switched on and the transistor Tr1 is switched off. This establishes electric connection between the data line 14 and the electrode Eb1 of the capacitive element Cb. At this time, a potential, represented by "Vss+Vdata", is supplied as data signal X[j]. Charge corresponding to voltage Vdata is stored in the capacitive element Cb.

Next, in the driving period P3, the transistor Tr1 is switched on, thus electrically connecting the capacitive element Ca and the capacitive element Cb. The capacitive element Ca holds threshold voltage Vth and the capacitive element Cb holds voltage Vdata. Thus, gate potential Vg of the driving transistor Tdrn has a potential based on the sum voltage of threshold voltage Vth and voltage Vdata. This causes driving current Iel to be independent from threshold voltage Vth of the driving transistor Tdrn.

Similarly to the first embodiment, also in the first embodiment, the compensation period P1 and the data writing period P2 can overlap with each other. This can increase the times of the compensation period P1 and the data writing period P2. Thus, threshold voltage Vth can accurately be compensated and voltage Vdata can sufficiently be written. As a result, irregularity in brightness can be eliminated and display grayscale accuracy can be improved.

The reason that lower power-supply potential Vss is supplied to the power-supply line 17 is that, in the compensation period P1, the electrode Ea1 is set to be higher in potential than the electrode Ea2, and, in the data writing period P2, the electrode Eb1 is set to be higher in potential than the electrode Eb2. Therefore, in the compensation period P1 and the data writing period P2, the potential of the power-supply line 17 may be set to lower power-supply potential Vss.

Third Embodiment

Next, a third embodiment of the invention is described below. In the third embodiment, components common to those in the first embodiment are not described, if needed, since the components are denoted by identical reference numerals.

Figure 10:
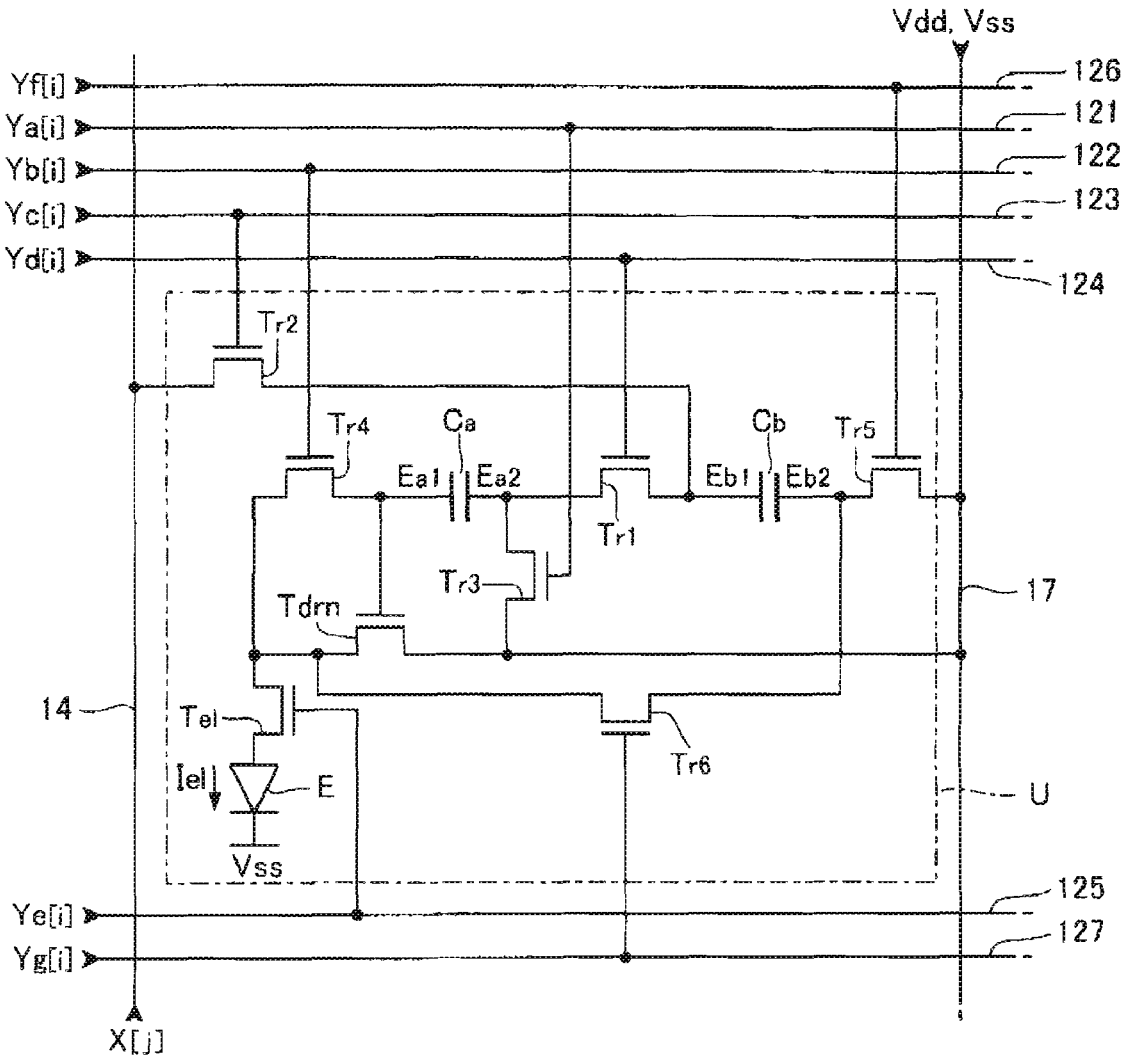
FIG. 10 is a circuit diagram showing the configuration of a unit circuit in the second embodiment of the invention.

FIG. 10 is a circuit diagram showing the configuration of the unit circuit U in the third embodiment. The unit circuit U in the third embodiment is identical in configuration to that in the first embodiment except that the driving transistor Tdrn is used instead of the driving transistor Tdrp, that transistors Tr5 and Tr6 are added, and that a sixth control line 126 for supplying sixth control signal Yf[i] and a seventh control line 127 for supplying seventh control signal Yg[i] are added.

Figure 11:
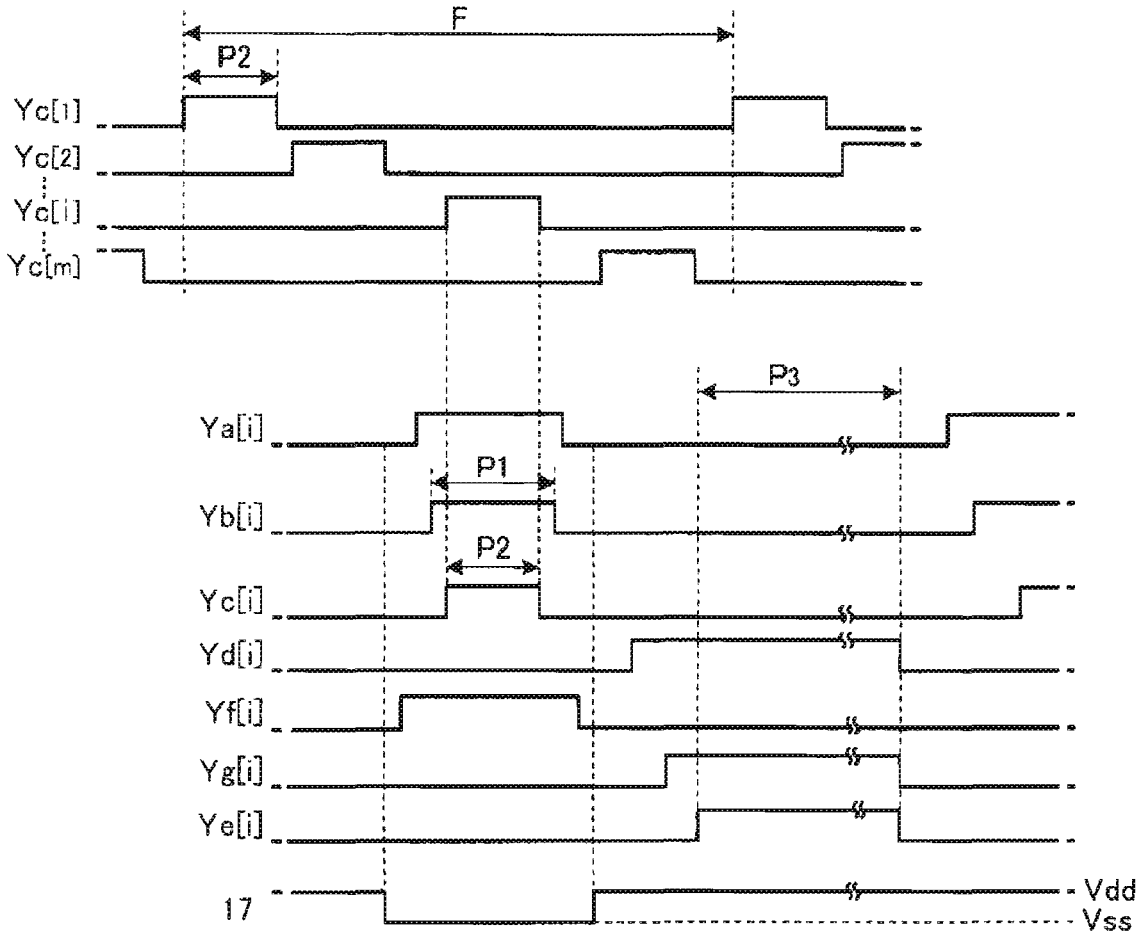
FIG. 11 is a timing chart illustrating an operation of an electronic device.

FIG. 11 shows specific waveforms of signals used in the electronic device D. As shove in FIG. 11, a high level time decreases in the order of a period in which sixth control signal Yf[i] is high in level, a period in which first control signal Ya[i] Is high, a period in which second control signal Yb[i] is high in level, and a period in which third control signal Yc[i] is high in level. The period in which second control signal Yb[i] is high is the compensation period P1 in which the compensating operation is performed. The period in which third control signal Yc[i] is high is the data writing period P2 in which the writing operation is performed. In this example, the compensation period P1 includes the data writing period P2.

Figure 12:
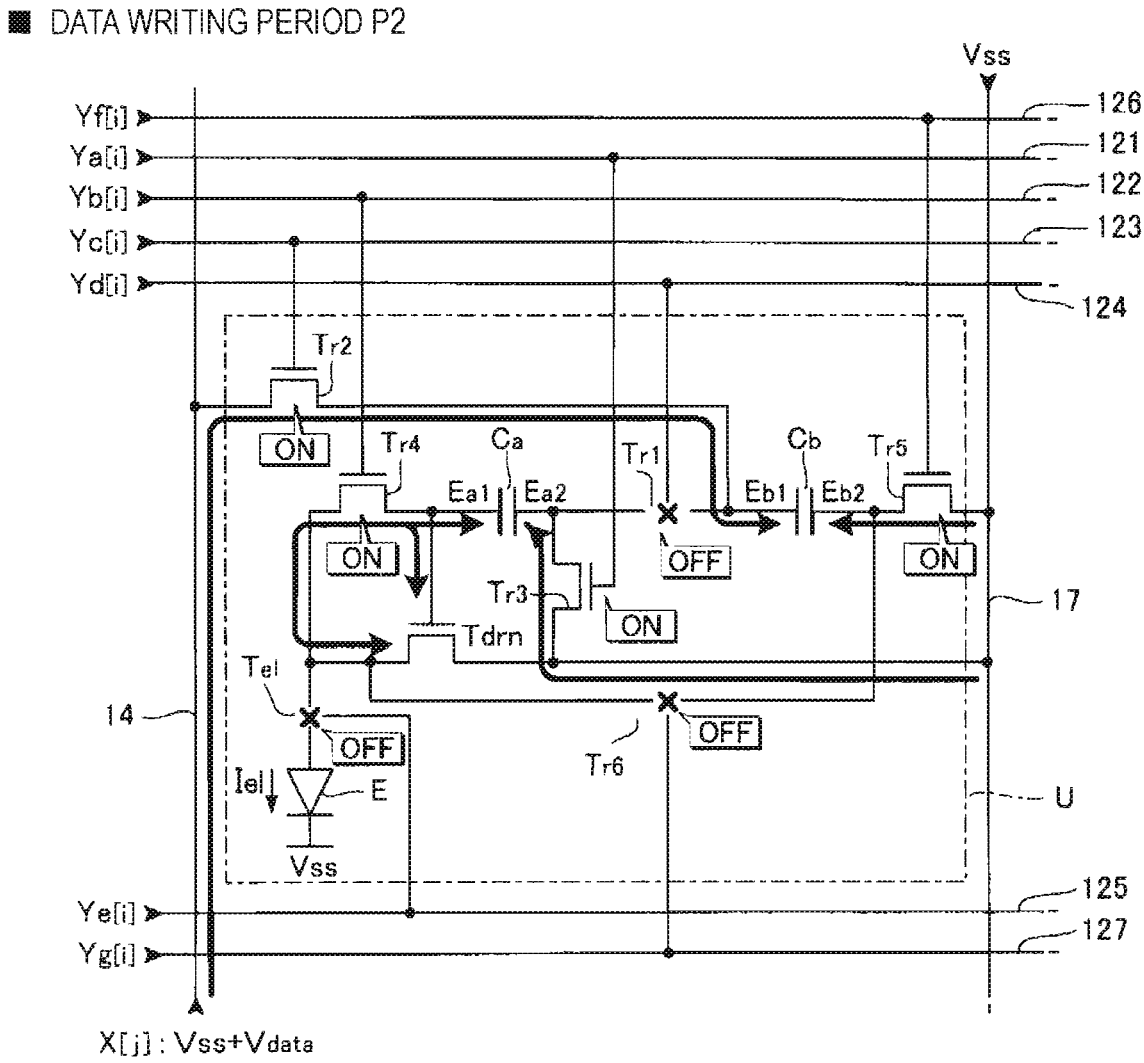
FIG. 12 is a circuit diagram showing details of the unit circuit in the data writing period.

FIG. 12 shows details of the unit circuit U in the data writing period P2. In this state, the transistor Tr3 is switched on, thus supplying lower power-supply potential Vss to the electrode Ea2 of the capacitive element Ca. In addition, the transistor Tr4 is switched on, thus causing the driving transistor Tdrn to be connected to operate as a diode, so that a current flows from the source to drain of the driving transistor Tdrn, and the potential of the electrode Ea1 of the capacitive element Ca gradually approaches a value represented by "Vss+Vth". This stores charge corresponding to threshold voltage Vth in the capacitive element Ca.

In addition, for the capacitive element Cb, the transistor Tr2 is switched on, and the transistor Tr1 is switched off. This establishes electric connection between the data line 14 and the electrode Eb1 of the capacitive element Cb. At this time, the potential "Vss+Vdata" is supplied as data signal X[j]. Charge corresponding to voltage Vdata is stored in the capacitive element Cb.

In addition, in the data writing period P2, the transistor Tr1 is switched off, thus electrically separating the capacitive elements Ca and Cb. Furthermore, the transistor Tr6 is switched off, thus electrically separating the source of the driving transistor Tdrn and the electrode Eb2 of the capacitive element Cb.

Figure 13:
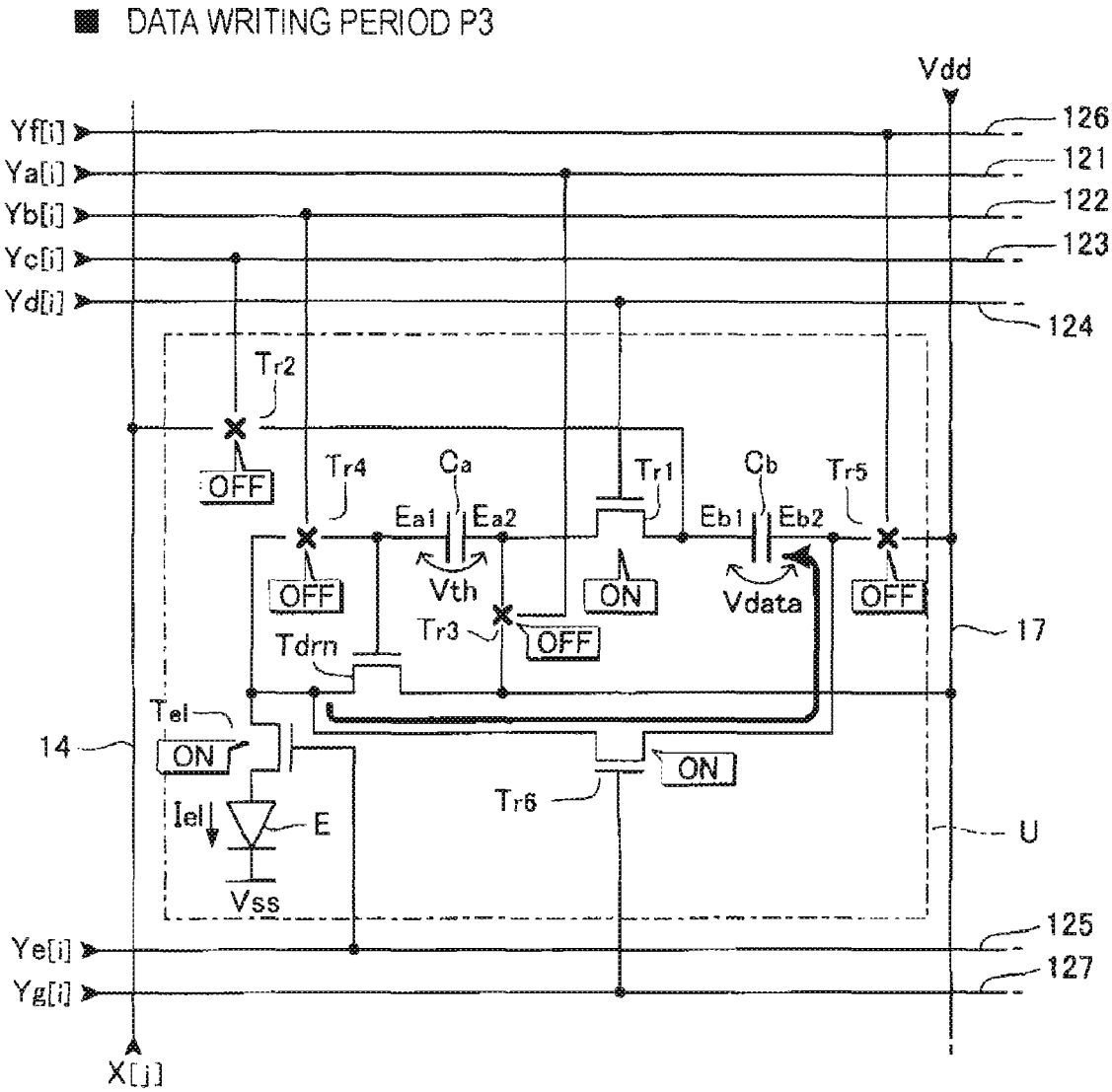
FIG. 13 is a circuit diagram showing details of the unit circuit in the driving period.

FIG. 13 shows details of the unit circuit U in the driving period D3. In this state, the transistor Tr3 is switched off thus electrically separating the electrode Ea2 of the capacitive element Ca from the power-supply line 17. The transistor Tr4 is switched off, thus disconnecting the diode-connected driving transistor Tdrp. In addition, the transistor Tr2 is switched off, thus electrically separating the data line 14 and the electrode Eb1 of the capacitive element Cb.

In addition, in the driving period P3, the transistor Tr1 is switched on, thus establishing electric connection between the electrode Ea2 of the capacitive element Ca and the electrode Eb1 of the capacitive element Cb. When the transistor Tr1 is used to connect the electrodes Eb1 and Eb2, a potential difference between the potential of the electrode Ea1 and the potential of the electrode Eb2 is represented by "Vdata+Vth". The transistor Tr6 is switched on, thus establishing electric connection between the source of the driving transistor Tdrn and the electrode Eb2 of the capacitive element Cb. This causes gate potential Vg to have a voltage, represented by "Vdata+Vth", higher than source potential Vs. As a result, driving current Iel is determined by voltage Vdata, and is independent from threshold voltage Vth of the driving transistor Tdrn.

Similarly to the first embodiment, in the third embodiment, the compensation period P1 and the data writing period P2 can overlap with each other. This can increase the times of the compensation period P1 and the data writing period P2. Thus, threshold voltage Vth can accurately be compensated and voltage Vdata can sufficiently be written. As a result, Irregularity in brightness can be eliminated and display grayscale accuracy can be improved.

Modifications

The above-described embodiments may variously be modified. Specific forms of modifications are exemplified below. The forms may variously be combined, if necessary.

Specific configurations of the unit circuit U are not limited to those in the above-described embodiments. For example, conductivity types of transistors included in the unit circuit U may be altered, if needed. In addition, the emission-control transistor Tel may be omitted, if needed.

In each of the above-described embodiments, the data writing period P2 and the compensation period P1 are not coincident with each other. However, the data writing period P2 and the compensation period P1 may be coincident with each other. In addition, the data writing period P2 and the driving period P3 may be continuous.

In each of the above-described embodiments, an OLED element is exemplified as the electro-optical element E. However, the electro-optical element (driven element) employed in an electronic device according to an embodiment of the invention is not limited to the OLED element. For example, instead of the OLED element, various types of electro-optical elements can be used, such as various self-emission elements such as inorganic EL (electroluminescent) elements, FE (field emission) elements, SE (surface-conduction electron-emitter) elements, BS (ballistic electron surface emitting) elements, and LED elements, and, in addition, liquid crystal elements, electrophoresis elements, and electrochromic elements. In addition, the invention is applicable to sensing devices such as biochips.

As exemplified above, the driven element in the invention is a concept including all types of elements that are controlled (driven) to predetermined states when being supplied with energy. The electro-optical elements, such as emission elements, are only examples of the driven element. Driven elements include, in addition to a current-driven element such as an OLED element, a voltage-driven element that is driven depending on a supplied voltage (hereinafter referred to as a "driving voltage"). In the electronic device D in which a voltage-driven driven element is employed, a potential determined depending on voltage Vdata and threshold voltage Vth is supplied as a control potential to the gate of the driving transistor Tdrp or Tdn, and a driving voltage whose value corresponds to the control potential is supplied to the driven element, whereby the driven element is driven.

Applications

Figure 14:
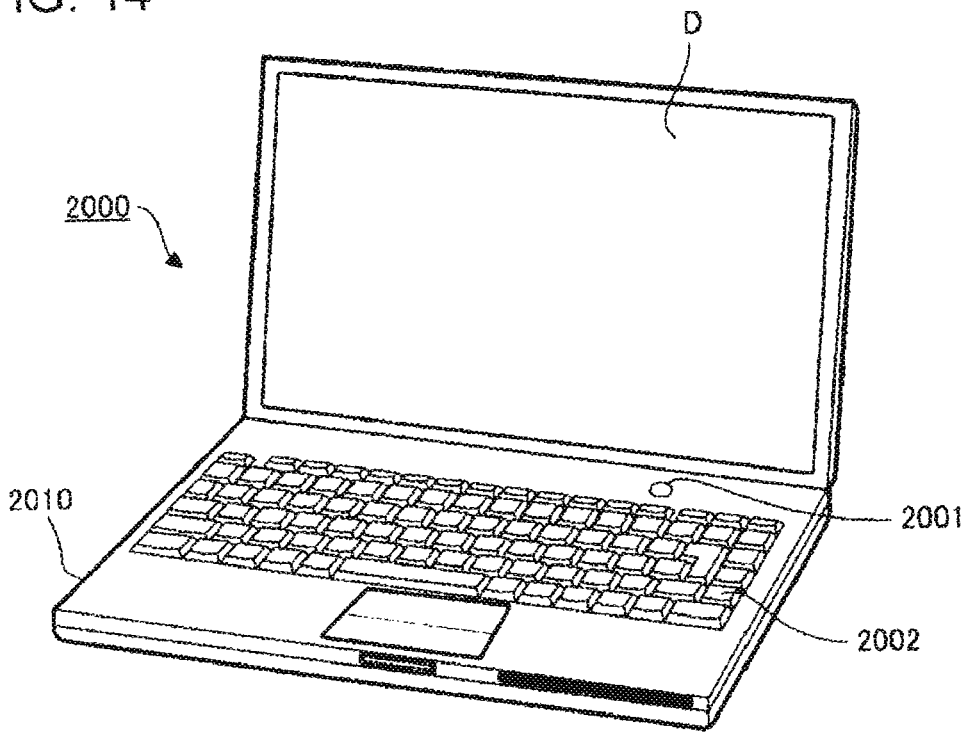
FIG. 14 is a perspective view showing a specific form of an electronic apparatus according to the invention.
Figure 15:
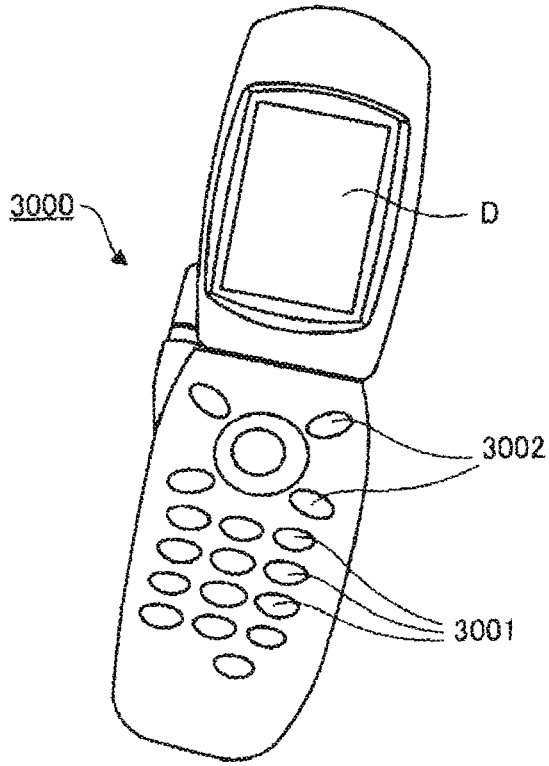
FIG. 15 is a perspective view showing a specific form of an electronic apparatus according to the invention.
Figure 16:
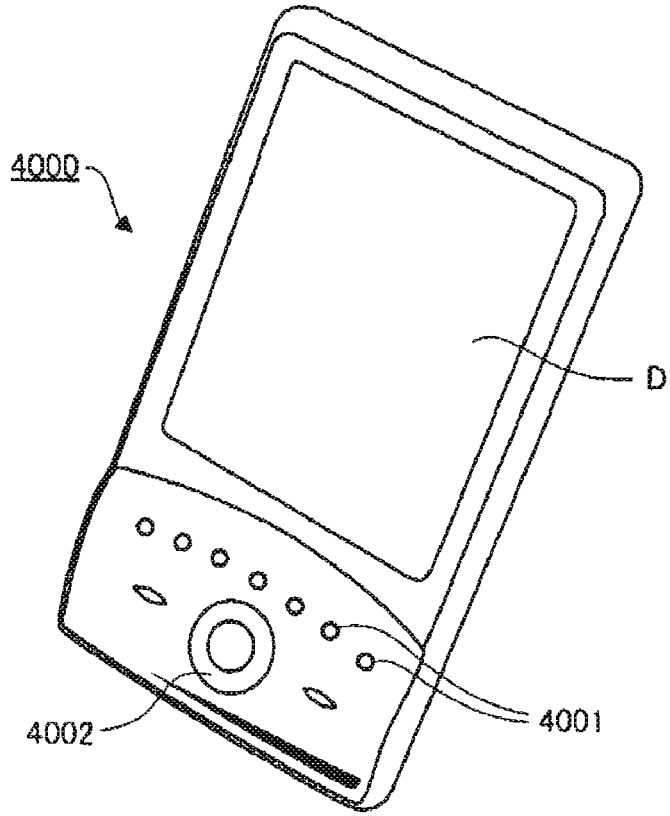
FIG. 16 is a perspective view showing a specific form of an electronic apparatus according to the invention.
Figure 17:
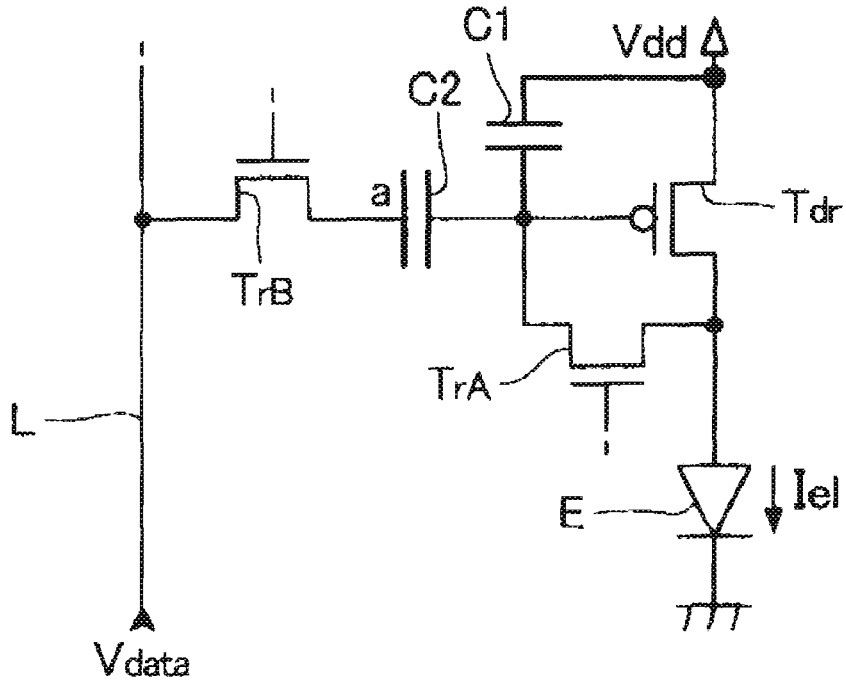
FIG. 17 is circuit diagram showing the configuration of an electronic device of the related arm.

Next, electronic apparatuses each using the electronic device according to each embodiment is described below. FIGS. 14 to 16 show electronic apparatuses in each of which the electronic device D according to each of the above-described embodiments is used as a display device.

FIG. 14 is a perspective view of a mobile personal computer 2000 that employs the electronic device D according to each embodiment. The personal computer 2000 includes the electronic device D for displaying various images, and a main unit 2010 provided with a power-supply switch 2001 and a keyboard 2002. The electronic device D can display an easily viewable screen having a wide angle of view since the electronic device D uses the OLED element as the electro-optical element E.

FIG. 15 shows a cellular phone 3000 that employs the electronic device D according to each of the above-described embodiments. The cellular phone 3000 includes a plurality of operating buttons 3001, a scroll button 3002, and the electronic device D for displaying various images. By operating the scroll button 3002, a screen displayed on the electronic device D can be scrolled.

FIG. 16 is a perspective view of a PDA (personal digital assistant) 4000 that employs the electronic device D according to each of the above-described embodiments. The PDA 4000 includes a plurality of operating buttons 4001, a power-supply switch 4002, and the electronic device D for displaying various images. By operating the power-supply switch 4002, various pieces of information, such as addresses and a schedule, can be displayed on the electronic device D.

Electronic apparatuses to which an electronic device according to an embodiment of the invention is applied include, in addition to the apparatuses shown in FIGS. 14 to 1.6, digital still camera, television sets, video cameras, car navigation apparatuses, pagers, electronic notebooks, electronic calculators, word processors, workstations, video phones, POS (point of sale) terminals, printers, scanners, copying machines, video players, apparatuses having touch-sensitive panels. In addition, uses of an electronic device according to an embodiment of the invention is not limited to display of images. For example, in an image forming apparatus such as a photo-writing printer or electronic copy machine, a write head for exposing a photo-sensitive material depending on an image to be formed on a recording material such as paper is used. An electronic device according to an embodiment of the invention is used as a write head of the above type.

What is claimed is:

1. A method for driving an electronic circuit for driving a driven element including: a transistor that includes a control terminal, a first terminal, and a second terminal, and in which a conduction state between the first terminal and the second terminal changes depending on a potential of the control terminal; a first capacitive element that includes a first electrode and a second electrode, the first electrode being electrically connected to the control terminal; and a second capacitive element that includes a third electrode and a fourth electrode, the driven element being supplied with at least one of a driving voltage having a voltage level based on the conduction state in the transistor and a driving current having a current level based on the conduction state in the transistor, the method comprising:

supplying a first voltage to the first capacitive element, the supplying of the first voltage being carried out during at least a part of a first period in which the second electrode is electrically separated from the third electrode separated;

supplying a second voltage to the second capacitive element, the supplying of the second voltage being carried out during at least a part of a second period in which the second electrode is electrically separated from the third electrode separated; and setting the potential of the control terminal by connecting electrically the second electrode and the third electrode.

2. The method according to claim 1, the potential of the control terminal set by the setting of the potential of the control terminal being a voltage representing a sum of the first voltage of the first capacitive element and the second voltage of the second capacitive element, and the sum of the first voltage and the second voltage being generated by carrying out the connecting electrically of the second electrode and the third electrode.

3. The method according to claim 1, the first voltage being a threshold of the transistor, and the second voltage being a data voltage.

4. The method according to claim 1, the supplying of the first voltage including electrically connecting the control terminal to the second terminal.

5. The method according to claim 1, the supplying of the second voltage including a supply of a data voltage to the third electrode.

6. The method according to claim 1, the setting of the potential of the control terminal including electrically connecting the e the first terminal to the fourth electrode.

7. A method for driving an electronic circuit for driving a driven element including: a transistor which includes a control terminal, a first terminal, and a second terminal, and in which a conduction state between the first terminal and the second terminal changes depending on a potential of the control terminal; a first capacitive element that includes a first electrode and a second electrode, the first electrode being electrically connected to the control terminal; and a second capacitive element that includes a third electrode and a fourth electrode, the driven element being supplied with at least one of a driving voltage having a voltage level based on the conduction state in the transistor and a driving current having a current level based on the conduction state in the transistor, the method comprising supplying a first voltage to the first capacitive element, the supplying of the first voltage being carried out during at least a part of a first period in which the second electrode is electrically separated from the third electrode separated;

supplying a second voltage to the second capacitive element, the supplying of the second voltage being carried out during at least a part of the first period; and setting the potential of the control terminal by connecting electrically the second electrode and the third electrode.

8. The method according to claim 7, the supplying of the first voltage including electrically connecting the control terminal to the second terminal.

9. An electronic circuit for driving a driven element, comprising:

a transistor which includes a control terminal, a first terminal, and a second terminal, and of which a conduction state between the first terminal and the second terminal changes depending on a potential of the control terminal;

a first capacitive element that includes a first electrode and a second electrode, the first electrode being coupled to the control terminal;

a second capacitive element that includes a third electrode and a fourth electrode; and a first switching element that controls a first electrical connection between the second electrode and the third electrode, the potential of the control terminal being set by electrically connecting the first capacitive element to the second capacitive element through the first switching element, the electrically connecting of the first capacitive element to the second capacitive element being carried out after supplying a first voltage to the first capacitive element and supplying a second voltage to the second capacitive element, and the driven element being supplied with at least one of a driving voltage having a voltage level corresponding to the conduction state of the transistor and a driving current having a current level corresponding to the conduction state of the transistor.

10. The electronic circuit according to claim 9, further comprising:

a wire electrically connected to the fourth electrode and being supplied with a predetermined potential; and a second switching element that controls a second electrical connection between the second electrode and the third electrode.

11. The electronic circuit according to claim 9, further comprising:

a wire that is supplied with a predetermined potential;

a second switching element that controls a second electrical connection between the second electrode and the wire;

a third switching element that controls a third electrical connection between the wire and the fourth electrode; and a fourth switching element that controls a fourth electrical connection between the fourth electrode and one of the first terminal and the second terminal.

12. An electronic device comprising:

a plurality of data lines; and a plurality of unit circuits, each of the plurality of unit circuits including:

a transistor which includes a control terminal, a first terminal, and a second terminal, and of which a conduction state between the first terminal and the second terminal changes depending on a potential of the control terminal;

a driven element that is supplied with one of a driving voltage having a voltage level according to the conduction state of the transistor and a driving current having a current level according to the conduction state of the transistor;

a first capacitive element that includes a first electrode and a second electrode, the first electrode being coupled to the control terminal;

a second capacitive element that includes a third electrode and a fourth electrode; and a first switching element that controls an electrical connection between the first capacitive element and the second capacitive element, the potential of the control terminal being set by electrically connecting the first capacitive element to the second capacitive element through the first switching element, the electrically connecting of the first capacitive element to the second capacitive element being carried out after supplying a first voltage to the first capacitive element and supplying a second voltage to the second capacitive element, and the driven element being supplied with at least one of a driving voltage having a voltage level corresponding to the conduction state of the transistor and a driving current having a current level corresponding to the conduction state of the transistor.

13. An electronic apparatus comprising the electronic device as set forth in claim 12.

* * * * *